US005489226A

United States Patent [19]

Nakamura et al.

[11] Patent Number: 5,489,226

[45] Date of Patent: Feb. 6, 1996

[54] HYDRAULIC ASSIST DEVICE FOR MARINE PROPULSION UNIT

[75] Inventors: Daisuko Nakamura, Hamamatsu; Yoshiyuki Katsumata, Kakegawa, both of Japan

[73] Assignee: Sanshin Kogyo Kabushiki Kaisha, Hamamatsu, Japan

[21] Appl. No.: 305,140

[22] Filed: Sep. 13, 1994

[30] Foreign Application Priority Data

Sep. 13, 1993 [JP] Japan ..... 5-227495
Sep. 13, 1993 [JP] Japan ..... 5-227496

[51] Int. Cl.[6] ..... B63H 21/26

[52] U.S. Cl. ..... 440/61; 251/213

[58] Field of Search ..... 440/55, 56, 61; 188/318; 251/213, 226, 227

[56] References Cited

U.S. PATENT DOCUMENTS 4,493,659 1/1985 Iwashita ..... 440/61
5,358,436 10/1994 Soda et al. ..... 440/55

*Primary Examiner*—Jesus D. Sotelo
*Attorney, Agent, or Firm*—Knobbe, Martens, Olson & Bear

[57] ABSTRACT

A hydraulic device for interposition between an outboard propulsion device and a watercraft transom for controlling the trim position of the propulsion device, for permitting the propulsion device to pop up when an underwater obstacle is struck and to return to the trim adjusted position and also including a bypass valve for permitting manual tilt up of the propulsion device without fluid restriction.

15 Claims, 9 Drawing Sheets

HYDRAULIC ASSIST DEVICE FOR MARINE PROPULSION UNIT

BACKGROUND OF THE INVENTION

This invention relates to a hydraulic assist device for a marine propulsion unit and more particularly to an improved device of this type.

It is well known to provide a hydraulic assist device that is interposed between a marine propulsion device such as an outboard motor or the outboard drive portion of an inboard/outboard drive and the transom of the associated watercraft. These devices serve a number of functions. Generally, the device is designed so as to permit the outboard drive to pop up when an underwater obstacle is struck and then permit the unit to return to its normal position. Preferably, the return should be to the previous trim adjusted position.

These devices normally include a cylinder that is connected to one of the watercraft and propulsion device and a piston that is contained within the cylinder and which is connected to the other of the watercraft and propulsion device. The piston divides the interior of the cylinder into a pair of fluid chambers and valves are provided in the piston so as to permit restricted flow from one chamber to the other when the underwater obstacle is struck and to provide return flow once the underwater obstacle is cleared.

In addition to these functions, it is also a common practice to provide a pressurized gas in one of the fluid chambers which acts to counterbalance at least the weight of the outboard drive so as to assist in manual tilting up of the outboard drive. In order to permit this manual tilting up without fluid resistance, a bypass line interconnects the two fluid chambers, and a valve is positioned in this bypass line that can be selectively opened and closed.

As should be readily apparent, these types of devices have a number of advantages, but also the prior art types of devices have some disadvantages, which can be best understood by reference to FIGS. 1–6. FIG. 1 is a schematic showing of the device FIGS. 2–6 are various views of the actual construction of the type utilized in the prior art. FIG. 2 2 is a side elevational view. FIG. 3 is a cross-sectional view taken along a plane extending perpendicular to the plane of FIG. 2. FIG. 4 is a cross-sectional view taken along the line 4—4 of FIG. 2. FIG. 5 is a cross-sectional view taken along the line 5—5 of FIG. 4 and shows the bypass valve in its normal condition. FIG. 6 is a cross-sectional view, in part similar to FIG. 5, and shows the bypass valve in its manual tilt-up position.

The prior art type of construction is indicated generally by the reference numeral 21. The manner in which it is adapted to be attached to the associated watercraft will be obvious to those skilled in the art, but FIG. 7, a view showing a preferred embodiment of the invention, may be referred to in order to determine how the device 21 is actually interposed between the watercraft transom and the outboard drive unit.

The device 21 is comprised of an outer cylinder assembly, indicated generally by the reference numeral 22. This cylinder assembly 22 has a trunion 23 formed at one end thereof to provide a pivotal connection to one of the transom and outboard drive. In the illustrated embodiments, this is to the outboard drive.

The cylinder assembly 22 is provided with an inner cylindrical bore 24 in which a piston, indicated generally by the reference numeral 25, is provided. The piston 25 divides the internal chamber of the cylinder 21 into an upper chamber 26 and a lower chamber 27. It should be noted that the upper chamber 26 is closed by a blind end of the cylinder assembly 22. The lower end of the chamber 24 is closed by a closure plug and gland assembly 28.

A piston rod 29 is affixed to the piston 25 and extends through the chamber 24 and beyond the enclosure and gland 28. A trunion 31 is fixed to the exposed end of the piston rod 29 to provide a pivotal connection to the remainder of the transom and outboard drive (the transom in this instance).

The lower chamber 24 is completely filled with a hydraulic fluid, and the upper chamber 26 is partially filled with the hydraulic fluid, as indicated by the legend A in the figure. The area in the chamber 26 above the fluid level A is filled with a compressed inert gas, such as nitrogen, in the area indicated at B. The chamber B is pressurized sufficiently so as to counterbalance some of the weight of the outboard drive for assisting in tilt-up action, as will become apparent.

Contained within the piston assembly 25 is a pressure responsive absorber valve, indicated generally by the reference numeral 32, and which is designed, in accordance with the attachment to the propulsion device and transom as aforedescribed, so as to permit flow from the chamber 27 to the chamber 26 when sufficient force is encountered on the outboard drive so as to cause it to pop up to clear the underwater obstacle that may have been struck. However, the pressure at which the valve 32 opens is set high enough so as to resist popping up of the outboard drive when operating in a reverse mode.

Once the underwater obstacle is cleared, the weight of the outboard drive causes fluid to be displaced from the chamber 26 back to the chamber 27 through a passage containing a relatively light let-down check valve 33.

It should be readily apparent that if an operator wished to tilt up the outboard drive through manual force, he would have to exert sufficient force so as to open the absorber valve 32. This obviously is more force than is desirable. Therefore, there is provided between the chambers 26 and 27 a tilt-up release valve, indicated generally by the reference numeral 34, and this is positioned in a bypass conduit that is indicated by the reference numeral 35. The structure is shown schematically in FIG. 1 and in actuality in FIGS. 2–6.

The passage 35 is comprised of a passage that is drilled axially through one end of the cylinder 22, and specifically the end adjacent the closure plug and gland 28. The outer end of this passage is closed, and the passage is cross drilled so as to communicate with the chamber 27. The upper end of this drilled passageway intersects a further passageway 36 that is drilled through the upper end of the cylinder 22 in proximity to the uppermost position of the piston 25. The outer end of the passageway 36 is closed by a plug 37.

This cross-drilled passageway 36 is offset from the vertically extending passageway, which is indicated by the reference numeral 38, and that passageway terminates in an area where a ball-type check valve 39 is positioned. The ball-type check valve 39 is normally urged to a closed position by means of a coil compression spring 41 so that the drilled portions 36 and 38 do not normally communicate with each other.

As may be seen in FIG. 1, the check valve formed by the ball 39 and spring 41 will permit passage of fluid from the chamber 26 to the chamber 27, but not in the reverse direction. The valve 39 is set to open at a relatively high pressure. In order to open the valve 39 manually, there is provided a manually rotatable actuator shaft, indicated generally by the reference numeral 42, which is journaled in the cylinder assembly 22 at a point offset from the drillings 38 and 36. A pin 43 is slidably supported in a further passageway 44 and engages a cam surface 45 formed on the actuator shaft 42. Upon rotation of the actuator shaft 42, the cam 45 will urge the pin 44 in a direction so as to unseat and open the ball check valve 39, as shown in FIG. 5. In this condition, the release valve 34 is opened, and this open passageway is shown schematically at 46 in FIG. 1.

As has been previously noted, when the release valve 34 is placed in its open position, the gas pressure in the chamber B will assist in the operator's lifting the propulsion unit without having to carry its full weight. However, this type of construction has several disadvantages, which will now be described.

First, it should be noted that the construction is such that in order to retain the outboard drive in its tilted-up position, some form of mechanical latch system must be provided. The reason for this is that even if the release valve 34 is moved to its closed position, as shown in FIG. 1, the weight of the outboard motor will cause fluid to be displaced from the chamber 26 through the light let-down valve 33 to the chamber 27, and the propulsion unit will return to a lowered position.

In addition, the trimmed-down condition of the outboard motor cannot be controlled by the hydraulic assembly as thus far described. This is because any downward forces, even when the release valve 34 is in its closed position, as shown in FIG. 1, cannot function to retain the propulsion unit in its upper position. This is because of the let-down valve 33.

Of course, the let-down valve 33 could be eliminated and then the trimmed-down position maintained by setting a high enough pressure on the valve 39 by using a strong spring 41. However, this is not totally satisfactory because the operator must manually overcome the action of the spring 41 to achieve a tilt up. Thus, it is typical with this type of construction to use a trim pin between the clamping bracket and swivel bracket of the outboard drive, and this must be adjusted manually each time the trim is to be changed. This is obviously not desirable.

Also, because of the type of valve employed and the fact that the pin 43 obscures part of the flow passage, the amount of pressure-assisted tilt-up operation is restricted, and this reduces the effect of the gas pressure assist.

In addition to these disadvantages, the ball valve 39 must also be forced against hydraulic pressure to release it, as well as the spring pressure, and this makes even manual release of the valve difficult.

It is, therefore, a principal object of this invention to provide an improved hydraulic assist device for a marine propulsion unit.

It is a further object of this invention to provide a hydraulic assist device for a marine propulsion unit that will be capable of setting the trim adjusted position of the marine propulsion unit and which will ensure that the unit returns to that position once it has popped up after striking an underwater object.

It is a further object of this invention to provide an improved release valve assembly for a hydraulic assist device for a marine propulsion unit.

SUMMARY OF THE INVENTION

A first feature of the invention is adapted to be embodied in a hydraulic device for interpositioning between an outboard propulsion device and a watercraft transom for controlling the trim position of the propulsion device relative to the transom. The device comprises a cylinder assembly that is adapted to be affixed to one of the transom and the propulsion device and which defines a fluid cavity. A piston is reciprocally supported in the fluid cavity and divides the cavity into first and second fluid chambers. Means are provided for operably connecting the piston to the other of the transom and propulsion device for effecting relative movement of the piston and cylinder upon relative movement between the propulsion device and the transom. An absorber valve is provided that permits fluid flow from one of the chambers to the other of the chambers when an underwater obstacle is struck with sufficient force. A let-down valve is provided for permitting flow from the other chamber to the one chamber when the underwater obstacle is cleared. A bypass conduit interconnects the two chambers and has a release valve positioned in it that can be opened for permitting free flow between the chambers for manual tilt up. A floating piston is positioned within one of the chambers and divides the chamber into first and second portions. A gas under pressure is contained within the second portion of the one fluid chamber for exerting a lift force on the propulsion unit to compensate for at least some of its weight.

Another feature of the invention is adapted to be embodied in an improved release valve, which may be employed in a hydraulic device as set forth in the preceding paragraph. This release valve comprises a housing defining a fluid passage. A ball-type check valve is urged by a compression spring an axial direction into sealing relationship with the passage. A release operator is provided that acts on the ball check valve in a direction normal to the axial direction for unsealing the ball valve and opening the flow through the passage.

DETAILED DESCRIPTION OF THE PREFERRED EMBODIMENT OF THE INVENTION

Figure 1:
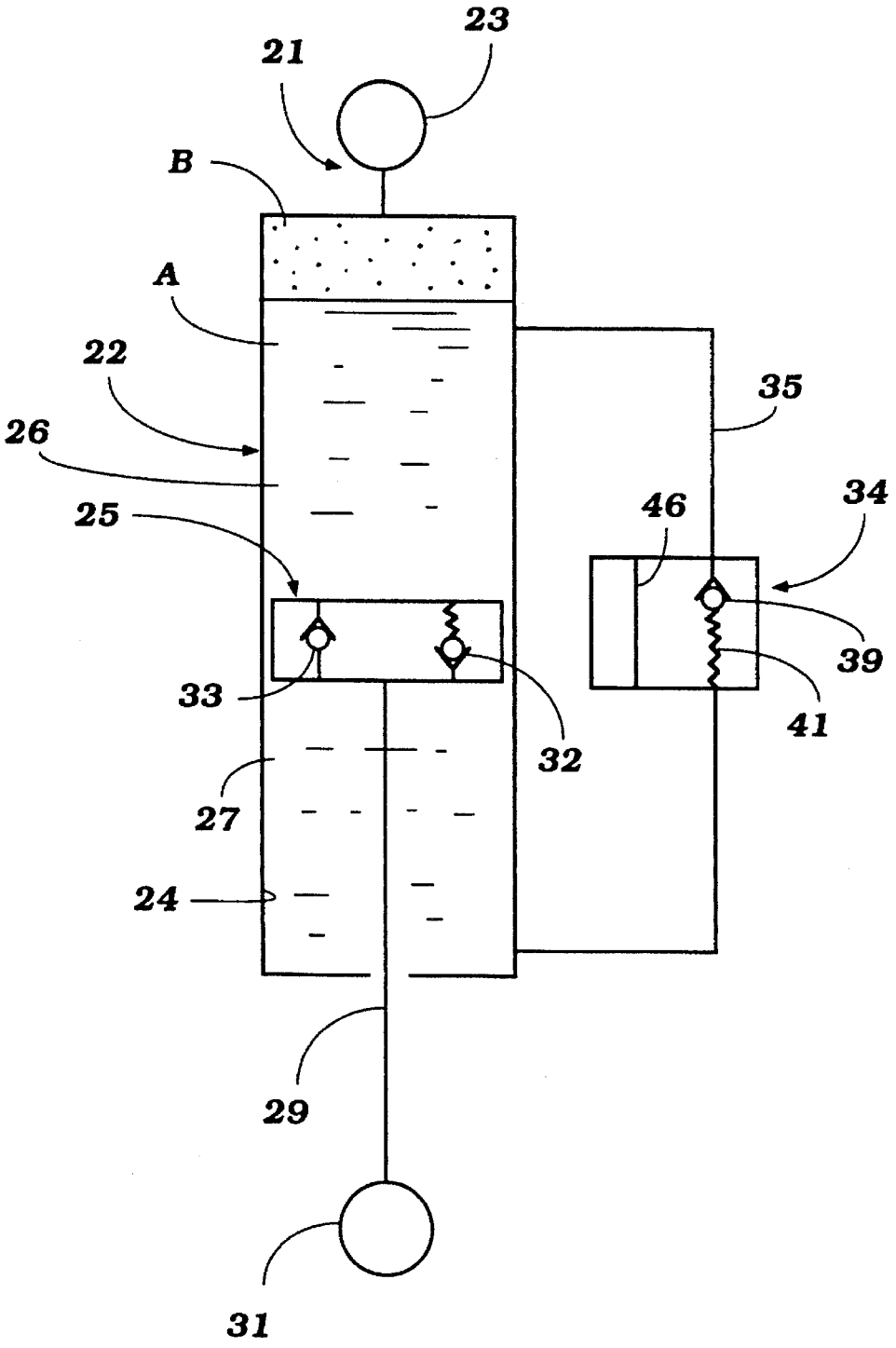
Figure 1 Prior Art
FIG. 1 is a schematic showing of the prior art type of device.
Figure 2:
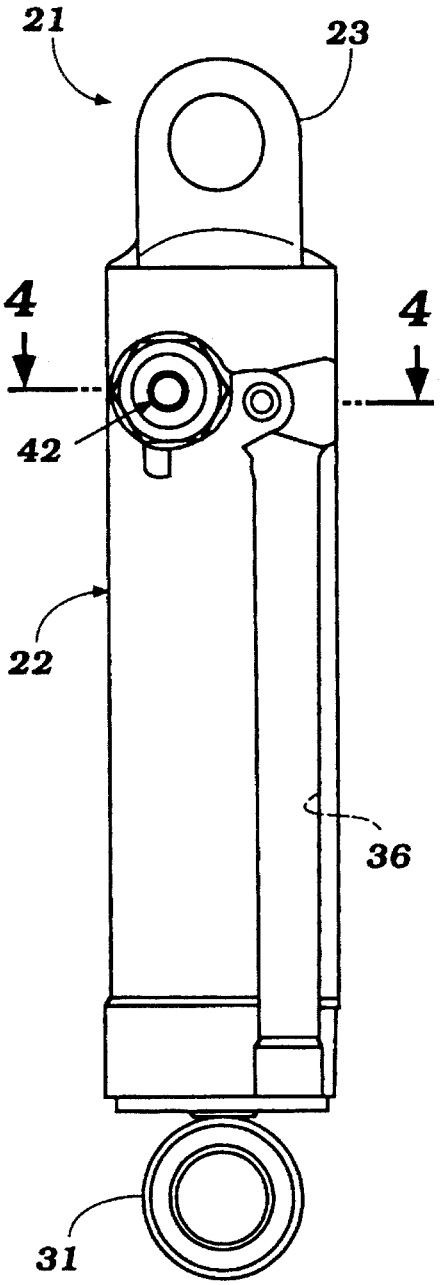
Figure 2 Prior Art
FIG. 2 is a side elevational view of the prior art device.
Figure 3:
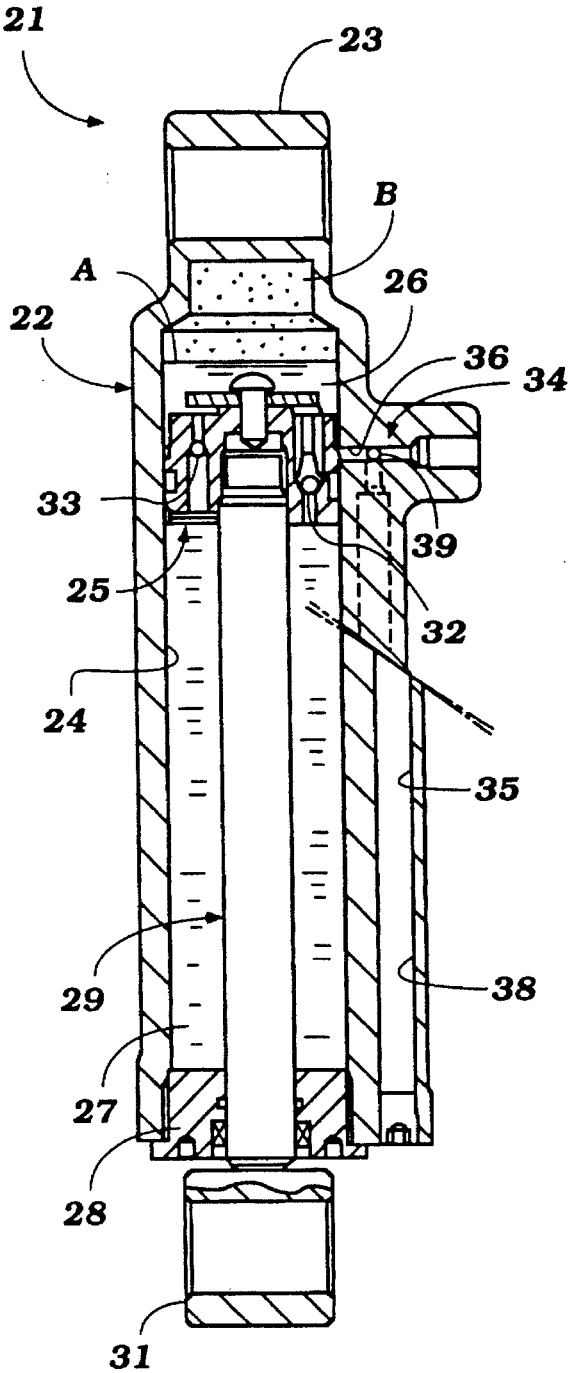
Figure 3 Prior Art
FIG. 3 is a cross-sectional view taken along a plane extending perpendicular to the plane of FIG. 2.
Figure 4:
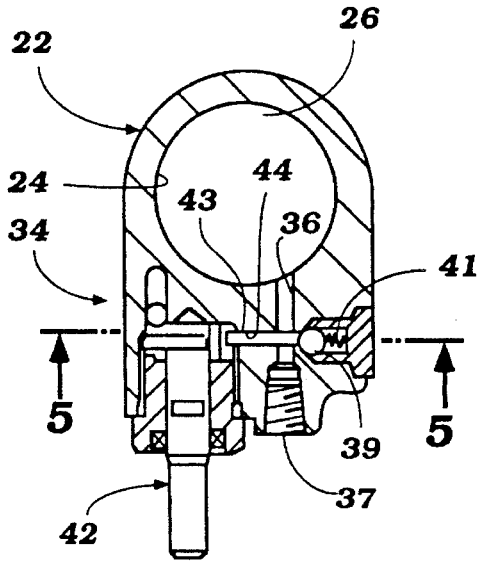
Figure 4 Prior Art
FIG. 4 is a cross-sectional view taken along the line 4—4 of FIG. 2.
Figure 5:
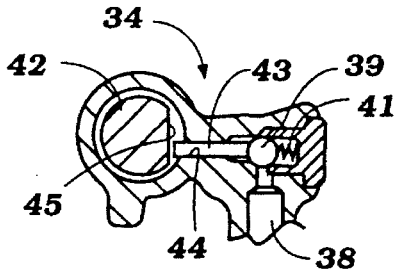
Figure 5 Prior Art
FIG. 5 is a cross-sectional view taken along the line 5—5 of FIG. 4 and shows the bypass valve in its normal condition.
Figure 6:
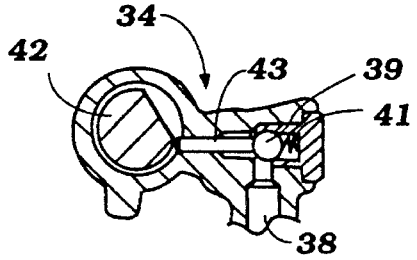
Figure 6 Prior Art
FIG. 6 is a cross-sectional view, in part similar to FIG. 5, and shows the bypass valve in its manual tilt-up position.
Figure 7:
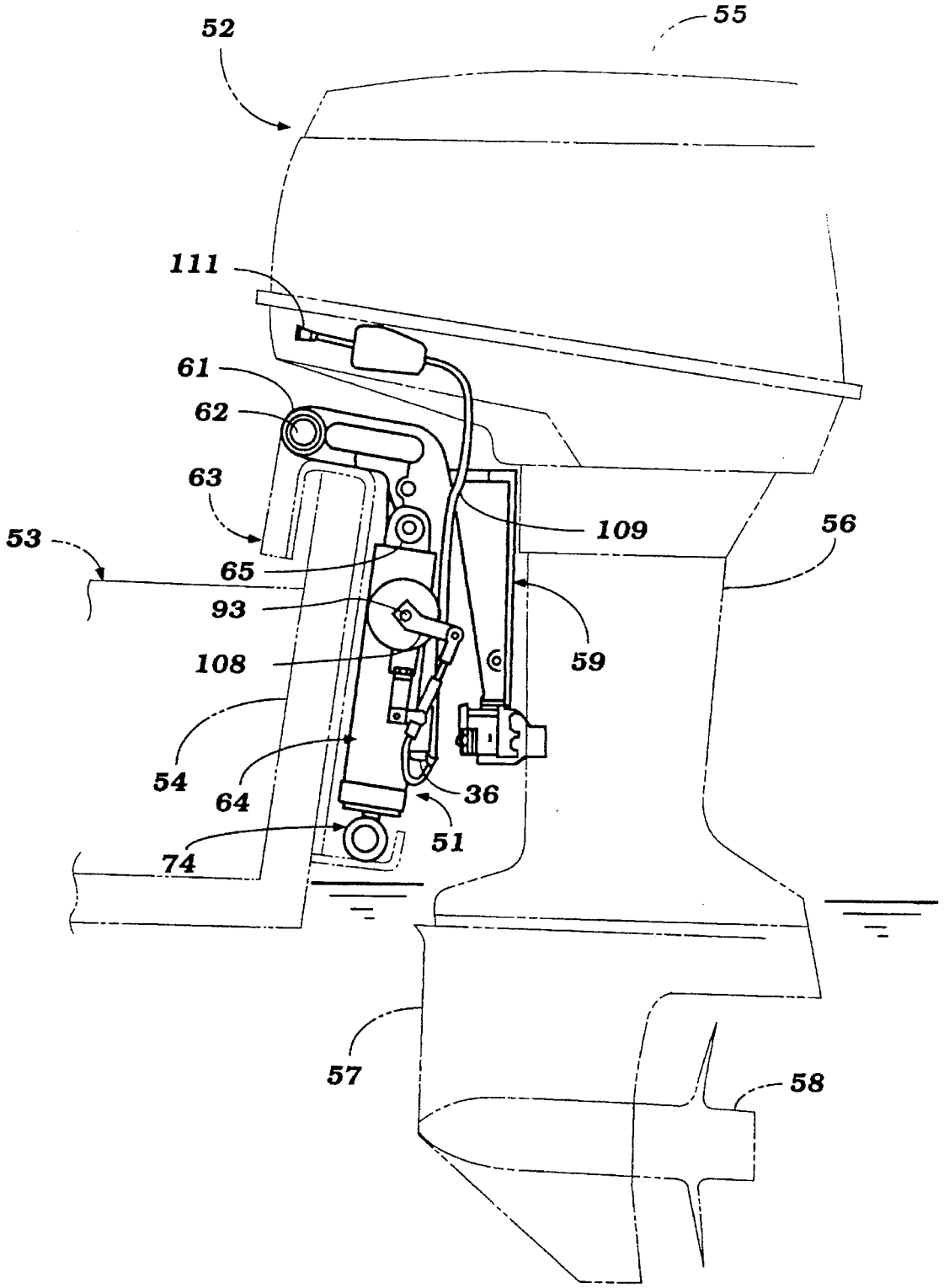
FIG. 7 is a side elevational view of a hydraulic assist device for a marine propulsion unit constructed in accordance with an embodiment of the invention and is in part similar to FIG. 2 of the prior art illustration but shows the connection to the propulsion device and watercraft, which are shown in phantom and partially in the case of the watercraft.

Referring first to FIG. 7, a hydraulic assist device constructed in accordance with an embodiment of the invention is identified generally by the reference numeral 51 and is depicted as associated with an outboard motor, shown primarily in phantom and identified by the reference numeral 52, as attached to a watercraft 53, which is shown only partially and in phantom, and specifically to the transom 54 thereof. As has been previously noted, the invention, although it has particular utility in conjunction with the outboard motor 52, can also be used with other types of outboard propulsion devices for watercraft such as the outboard drive portion of an inboard/outboard drive. The type of mechanism described, however, is more likely utilized in conjunction with outboard motors.

For orientation purposes, the outboard motor 52 is comprised of a power head 55 comprised of a powering internal combustion engine and surrounding protective cowling. The engine drives a drive shaft, which depends into and is journaled within a drive shaft housing 56 beneath the power head 55. A lower unit 57 at the lower end of the drive shaft housing 56 contains a propulsion device such as a propeller 58 which is driven from this drive shaft by means of a forward/neutral/reverse transmission.

A steering shaft (not shown) is affixed to the drive shaft housing 56 and is journaled for steering movement about a generally vertically extending steering axis in a swivel bracket, indicated generally by the reference numeral 59. The swivel bracket 59 has a forwardly extending portion 61 that is adapted to overlie the transom 54 and which is connected by means of a pivot pin 62 to a clamping bracket, shown in phantom and identified by the reference numeral 63. The pivot pin 62 defines the tilt and trim axis of the outboard motor 52, as is well known in this art.

Referring now primarily to FIGS. 8–13 and initially to FIGS. 8–11, the hydraulic assist device 51 is comprised of a cylinder assembly 64 having a trunion 65 at the end thereof for providing a pivotal connection to one of the outboard motor 52 and transom 53, and in this specific embodiment, the swivel bracket 59 of the outboard motor 52.

The cylinder assembly 64 is provided with a cylinder bore 66 which is blind at one end and which is closed at the other end by means of a combined closure plug and gland assembly 67. A piston assembly, indicated generally by the reference numeral 68, is slidably supported within the cylinder bore 66 and divides the inner cavity of the cylinder 64 into a lower chamber 69 and an upper chamber 71. A floating piston 72 is slidably supported within the cylinder bore 66 in the chamber 71 and divides it into an upper portion and a lower portion, with the lower portion being disposed between the pistons 68 and 72.

A fluid indicated by the characters A and A' is contained in the lower chamber 69 and a portion of the upper chamber both below the floating piston 72 and above it. The area in the upper chamber above the fluid level is filled with a compressed inert gas such as nitrogen, indicated at B. The pressure of the gas B is chosen such that it will assist in offsetting some of the weight of the outboard motor 52 when it is being tilted up.

A piston rod 73 is affixed to the underside of the lower or first piston 68 and extends through the chamber 69 and gland 67. A trunion 74 is affixed to the lower, exposed end of the piston rod 73 so as to provide a pivotal connection to the other of the outboard motor 52 or hull transom 54, in this case to the transom 54 through the clamping bracket 63.

An absorber passage 75 extends through the piston 68 from the chamber 69 to the portion of the chamber 71 below the floating piston 72. A pressure responsive absorber valve 76 is provided in this passage 75 so as to permit flow from the chamber 69 to the lower portion of the chamber 71 but to preclude flow in the reverse direction. Flow occurs in this direction, as aforenoted, when an underwater obstacle is struck with sufficient force.

A let down passage 77 is also formed in the piston 68 and a light let down check valve 78 is provided in this passage so as to permit flow from the underside of the floating piston 72 in the chamber 71 to the chamber 69 when the underwater obstacle is cleared. Further description of the construction and operation of the valves 76 and 78 is not believed to be necessary in view of the foregoing description of the prior art type of construction inasmuch as these valves function the same in this arrangement as in the prior art with the exception that the floating piston 72 is provided in the chamber 71.

Figure 11:
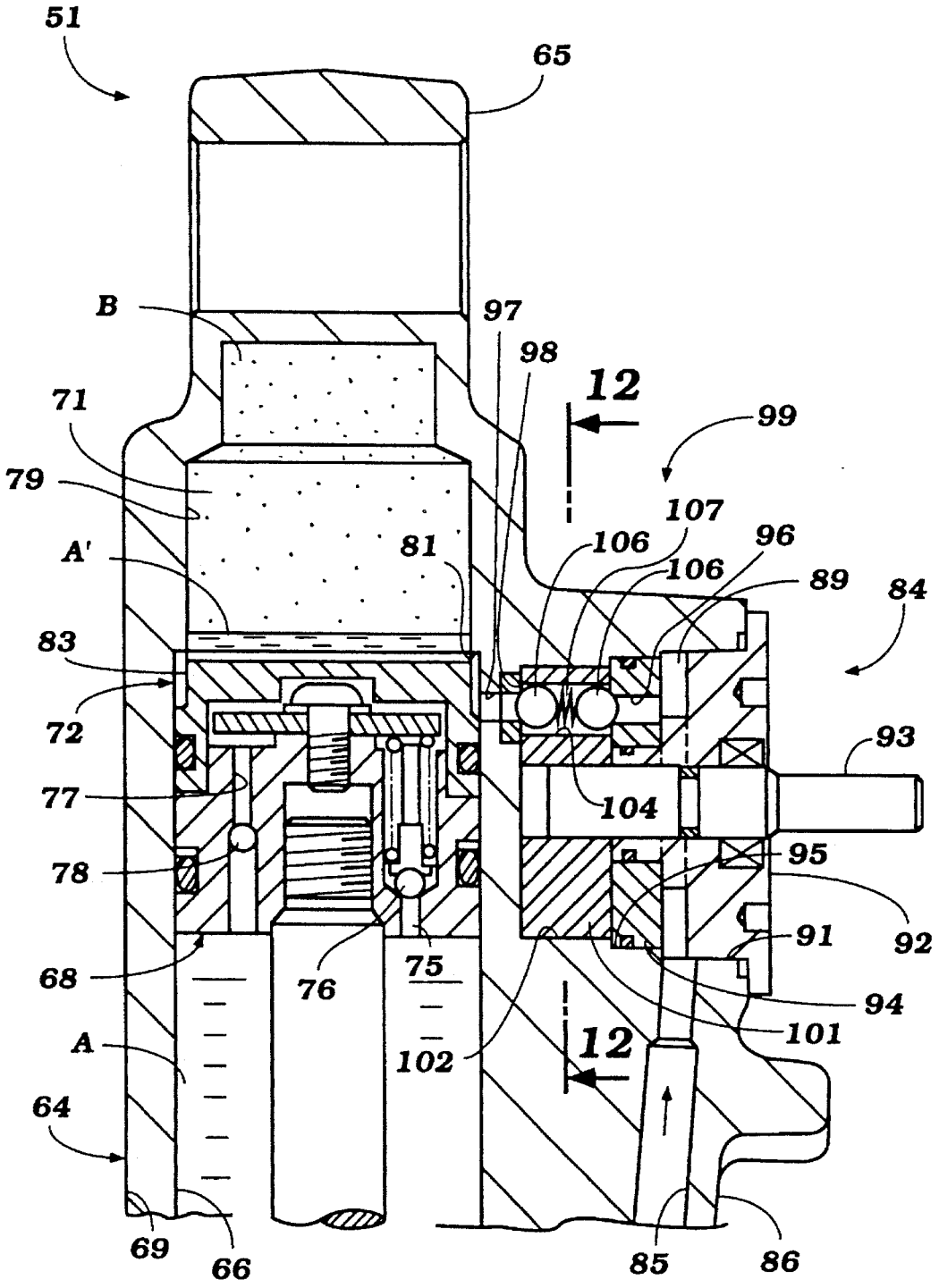
FIG. 11 is an enlarged cross-sectional view, in part similar to FIG. 10, but shows the release valve and piston and its valve in cross section.

The cylinder 64 is provided with a reduced diameter bore portion 79 at the upper end of the cylinder bore 66 so as to provide a stop shoulder 81. The floating piston 72 in a similar manner is provided with relief 83 at the upper end of its periphery so as to provide a clearance between the cylinder bore 66 and the upper end of the floating piston 72. This reduced diameter portion 83 is larger in diameter than the smaller cylinder bore 79 so that the floating piston 72 can contact the shoulder 81 and limit the degree of downward movement of the cylinder 64 relative to the fixed piston 68 and piston rod 73. When this occurs, as shown in FIG. 11, the floating piston 72 will be contacted by the piston 68.

A manually operated release valve, indicated generally by the reference numeral 84 is provided for permitting free flow of hydraulic fluid between the chambers 71 and 69 if desired for manual tilt up operation. This release valve will now be described by particular reference to FIGS. 10–13 although certain components appear in other figures, and of course, the release valve 84 is shown schematically in FIG. 8.

The release valve 84 permits unrestricted flow through a first drilled passage 85 that extends through an embossment 86 formed on one side of the cylinder assembly 64 and which intersects the chamber 66 adjacent the gland 67 through a further drilled passageway 87. The lower end of the passageway 85 is closed by means of a closure plug 88.

At its upper end, the passageway 85 communicates with an annular chamber 89 (FIG. 11) formed by a first bore 91 that extends through the cylinder housing 64 generally perpendicularly to the cylinder bore 66. A closure plug 92 closes the outer end of the bore 91 and rotatably journals a valve operating shaft 93 which is operated in a manner which will be described.

An annular disk 94 is contained within a second bore 95 formed at the base of the housing bore 91. This disk 94 is provided with a passageway 96 that extends parallel to the bore 91 but which is offset to one side thereof. The passageway 96 is aligned with a further drilled passageway 97 that is formed in the cylinder 64 and which intersects the bore 66 at a point immediately below the shoulder 81. A valve seat 98 is provided at the end of the drilled passageway 97.

A valve assembly, indicated generally by the reference numeral 99 controls the communication between the passageways 96 and 97 and this valve 99 will now be described by primarily reference to FIGS. 11–13. The valve 99 includes an annular valve disk 101 that is journaled within a final bore 102 formed in the housing 64 at the base of the bores 91 and 95. This valve disk 101 is affixed in a suitable manner for rotation with the valve actuator shaft 93, for example by a splined or keyed connection. The valve element 101 is provided with a circumferentially slotted passage, indicated generally by the reference numeral 103 that is comprised of a larger portion 104 and a smaller portion 105. The width of the smaller portion 105 is such that it is substantially the same as the diameter of the passages 96 and 97 so as to afford free flow therebetween when in its open position as shown in FIG. 13.

Figure 12:
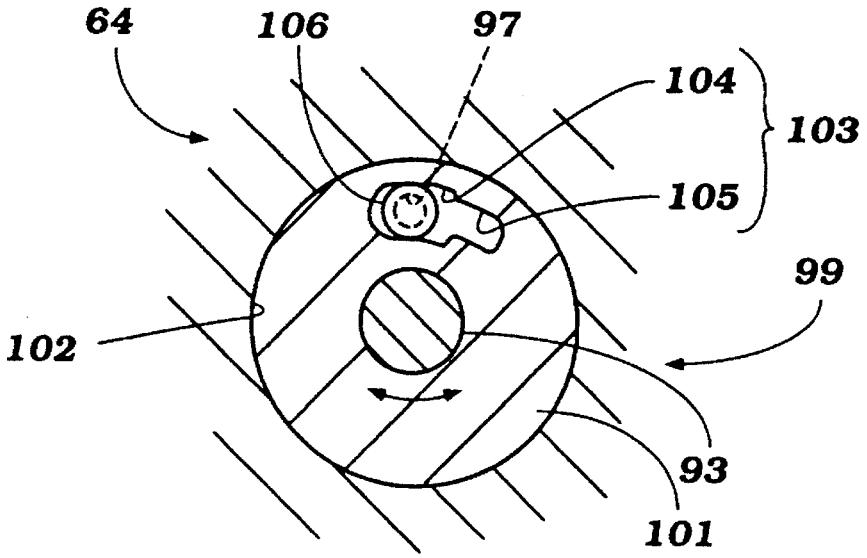
FIG. 12 is a cross-sectional view taken along the line 12—12 of FIG. 11 and shows the release valve in its closed position.
Figure 13:
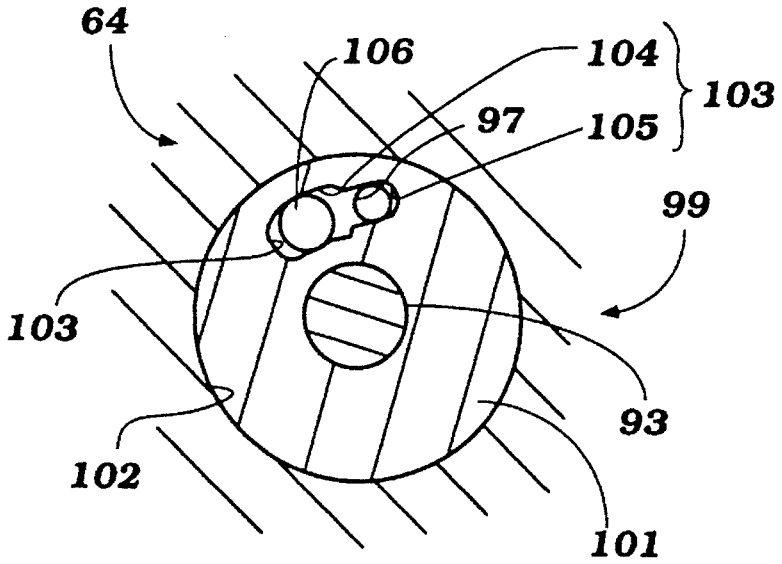
FIG. 13 is a cross-sectional view, in part similar to FIG. 12, and shows the release valve in its opened position.

The larger portion 104 captures a pair of ball-type valves 106 with a coil compression spring 107 trapped between them so as to urge the ball valves 106 into seating relationship with the valve seat 98 and the passageway 99 in the member 94 when the position as shown in FIG. 12 so as to provide a flow blocking condition in this position. Hence, when the construction is the position as shown in FIGS. 11 and 12, no flow will be permitted from the chamber 71 and to the chamber 69 or vice versa because of the closed position of the valve 99. This condition appears in FIG. 8 in a schematic fashion.

Referring to FIG. 7, the bypass valve assembly can be remotely operated and to this end, a lever actuator shaft 108 is affixed to the end of the valve shaft 93 and is connected by means of a bowden wire actuator 109 to a lever 111 mounted on the side of the outboard motor 52 or on the clamping bracket 63. By operating the lever 111, the valve disk 101 may be rotated from the closed position as shown in FIG. 12 to an opened position wherein the narrower slot 105 engages the balls 106 and displaces them from their seating relationship with the valve seat 98 and passage 96 so as to permit the flow as shown in FIG. 13. This free flow passage is indicated schematically as 112 in FIG. 8.

Figure 8:
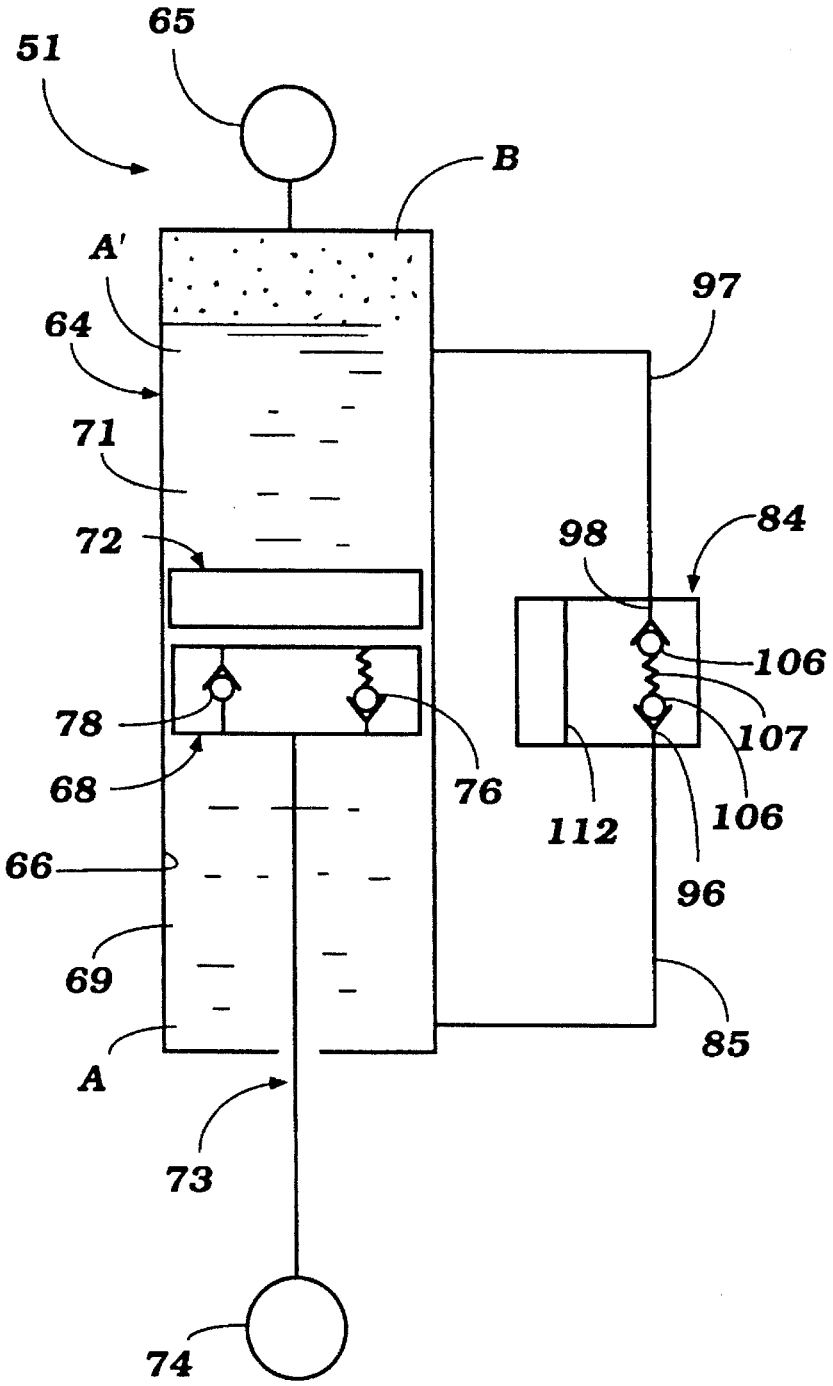
FIG. 8 is a schematic view of the hydraulic assist device in accordance with this embodiment and is similar in part to FIG. 1.
Figure 9:
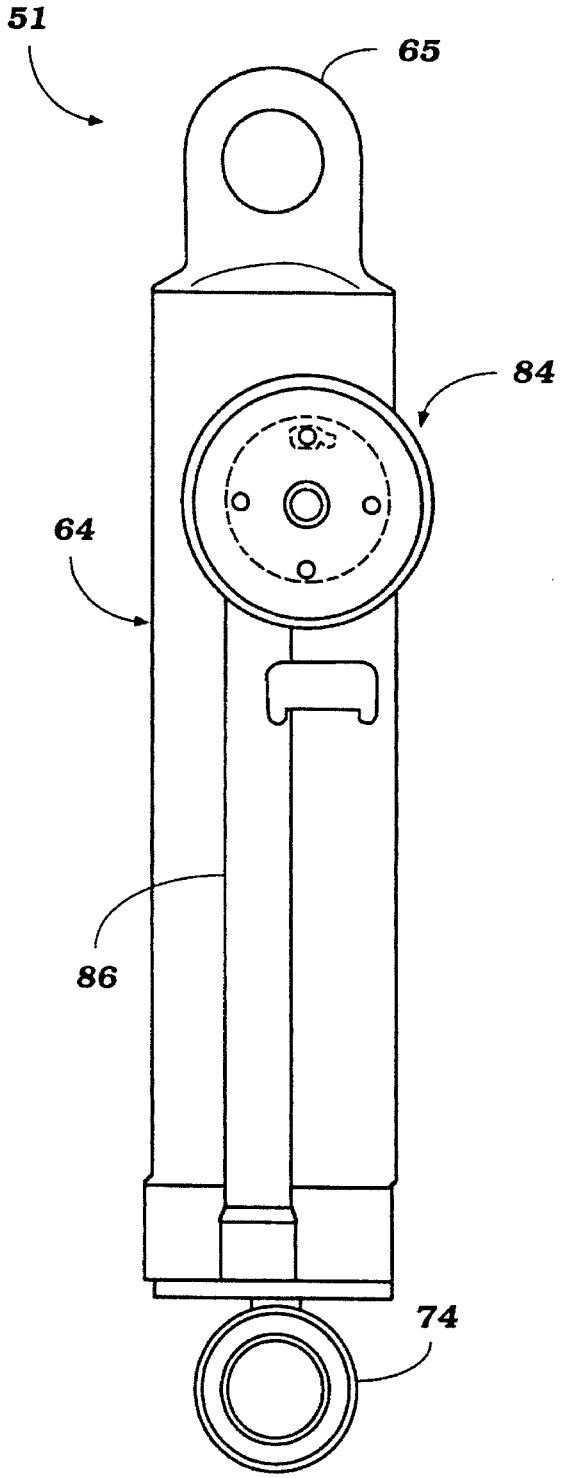
FIG. 9 is a side elevational view of the hydraulic assist device of the embodiment and is in part similar to FIG. 2.
Figure 10:
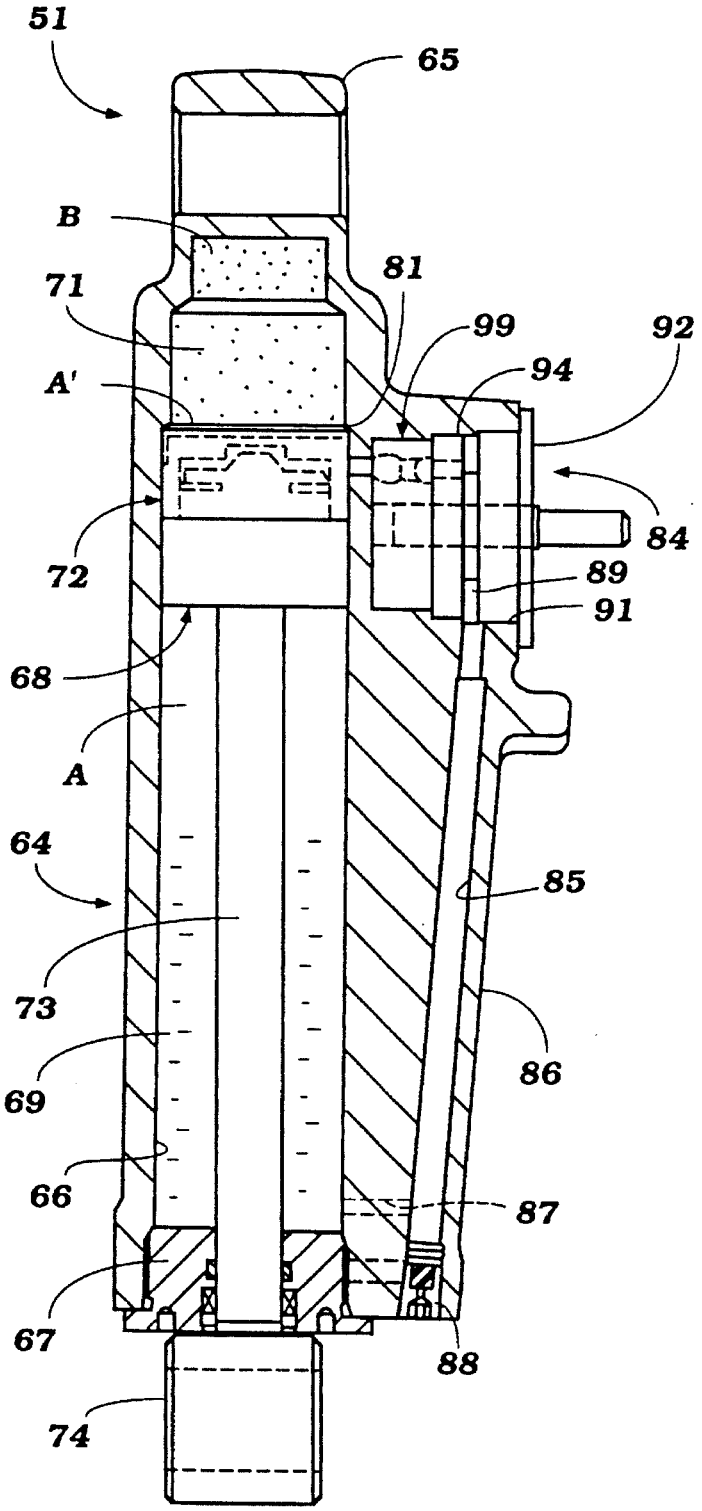
FIG. 10 is a cross-sectional view taken along a plane perpendicular to the plane of FIG. 9.

The unit 51 functions to set the trim position for the outboard motor 52, to allow it to pop up once an underwater obstacle is struck and to return to this trim adjusted position. This operation will now be described by reference to FIG. 8. FIG. 8 shows the piston 68 and floating piston 72 in an intermediate position which is between the fully trimmed down position when the piston 68 is substantially at the bottom of the cylinder bore 66 and a tilted up out of the water position. The position is probably somewhat slightly higher than the normal maximum trimmed up position but this is done for ease of illustration. Also, the floating piston 72 will normally be engaged with the piston 68 in the trimmed set position although the clearance is exaggerated in this figure.

If an underwater obstacle is struck with sufficient force so as to open the absorber valve 78, the cylinder 64 will move upwardly relative to the piston 68 and fluid will flow through the absorber valve 76 from the chamber 69 to the area of the chamber 71 under the floating piston 72. The amount of fluid displaced from the chamber 69 to the upper chamber 71 will be less than that required to fill the chamber 71 due to the fact that the piston rod 73 displaces part of the volume of the chamber 66. This will be accommodated for by some slight downward movement of the floating piston 72 relative to the upward movement of the cylinder 64.

Once the underwater obstacle is cleared, the cylinder 64 will be urged downwardly by the weight of the outboard motor 52 and the fluid from the portion of the chamber 71 beneath the floating piston 72 will be returned to the chamber 66 through the release valve 78. This downward movement will continue until the fluid equilibrium is reached and then the device will be retained in trim adjusted position. Increased driving forces will tend to force the cylinder 64 downwardly but this is not hydraulically possible and hence the trim adjusted position will be maintained.

If it is desired to tilt the outboard motor up, the release valve 84 is rotated to its open position and then fluid can then be easily displaced from the chamber 69 to the chamber 71 above the floating piston 72. This is possible even when starting in the fully trimmed down position as shown in FIG. 11 since the conduit 97 intersects the relief 83 at the top of the floating piston 72 so that such flow is possible. Once the desired tilted up position is reached, the release valve 84 is again closed and the hydraulic lock in the cylinder 64 will hold the trimmed up or tilted up position without the necessity of employing a mechanical stop or lock.

In addition to this advantage, it should be noted that the ball valves 106 are opened by applying a transverse force to them and hence the force will not need to resist the fluid pressure and ease of valve operation is possible.

Of course, it is to be understood that the foregoing description is that of a preferred embodiment of the invention and that various changes and modifications may be made without departing from the spirit and scope of the invention, as defined by the appended claims.

What is claimed is:

1. A hydraulic device for interpositioning between an outboard propulsion device and a watercraft transom for controlling the trim position of said propulsion device relative to said transom, said hydraulic device comprising a cylinder assembly adapted to be affixed to one of said transom and said propulsion device and defining a fluid cavity, a piston reciprocally supported in said fluid cavity and dividing said cavity into first and second fluid chambers, means for operatively connecting said piston to the other of said transom and said propulsion device for effecting a relative movement of said piston and said cylinder upon movement of said propulsion device relative to said transom, a first passage containing an absorber valve for permitting flow from a first of said chambers to the second of said chambers when a predetermined force is applied, a second passage comprising a let-down valve for permitting flow from said second fluid chamber to said first fluid chamber when the force is removed, a bypass passage containing a release valve for selectively communicating said chambers with each other and for normally precluding flow between said chambers but permitting flow between said chambers for effecting manual tilt-up operation, and a floating piston having a stepped outer shoulder on its outer periphery and contained within one of said chambers for fixing the trim adjusted position of said propulsion device, said bypass passage communication with said chambers at a point that is disposed adjacent said stepped outer shoulder of said floating piston when the floating..piston is in one extreme position.

2. The hydraulic device of claim 1, wherein the release valve is movable between a fully opened position and a fully closed position.

3. The hydraulic device of claim 1, wherein the stepped end of the floating piston engages a stop surface formed on the cylinder for limiting the degree of relative pivotal movement between the watercraft and the outboard propulsion device in one direction.

4. The hydraulic device of claim 1, further including a gas under pressure provided in one of the chambers.

5. The hydraulic device of claim 4, wherein the gas under pressure is disposed in the chamber receiving the floating piston on one side of the floating piston.

6. The hydraulic device of claim 5, wherein the one side of the floating piston is the upper side in the first fluid chamber.

7. The hydraulic device of claim 6, wherein the means for affixing the piston to the other of the transom and propulsion device comprises a piston rod extending through the second fluid chamber.

8. The hydraulic device for interpositioning between an outboard propulsion device and a watercraft transom for controlling the trim position of said propulsion device relative to said transom, said hydraulic device comprising a cylinder assembly adapted to be affixed to one of said transom and said propulsion device and defining a fluid cavity, a piston reciprocally supported in said fluid cavity and dividing said cavity into first and second fluid chambers, means for operatively connecting said piston to the other of said transom and said propulsion device for effecting a relative movement of said piston and said cylinder upon movement of said propulsion device relative to said transom, a first passage containing an absorber valve for permitting flow from a first of said chambers to the second of said chambers when a predetermined force is applied, a second passage comprising a let-down valve for permitting flow from said second fluid chamber to said first fluid chamber when the force is removed, a bypass passage containing a release valve for selectively communicating said chambers with each other and for normally precluding flow between said chambers but permitting flow between said chambers for effecting manual tilt-up operation, and a floating piston contained within one of said chambers for fixing the trim adjusted position of said propulsion device, said release valve comprising a housing defining a flow passage extending therethrough, a ball-type valve contained within said housing and urged by a coil compression spring in an axial direction to a closed position, and means for moving said ball-type valve transversely relative to said flow passage from its closed position to the opened position.

9. The hydraulic device of claim 8, wherein the housing defines a second passage in opposition to the first passage and valved by a second ball-type valve urged to its closed position by the coil compression spring and the means for moving the ball-type valve moves both of the ball-type valves transversely relative to their respective flow passages.

10. The hydraulic device of claim 9, wherein the means for moving the ball-type valves transversely comprises a member supported for pivotal movement about a rotary axis extending parallel to but offset from the passages.

11. The hydraulic device of claim 10, wherein the means for moving the balls comprises an annular disk having an opening formed therein extending circumferentially and defining a shoulder that is adapted to engage the ball-type valves and move the ball-type valves to their opened position while still permitting flow between the passages.

12. A valve assembly comprising an outer housing defining a flow passage therein, a ball type valve contained within said housing and urged by a coil compression spring in a axial direction to a closed position, and means for moving said ball type valve transversely relative to said flow passage from its closed position to an opened position.

13. The valve assembly of claim 9, wherein the means for moving the balls comprises an annular disk having an opening formed therein extending circumferentially and defining a shoulder that is adapted to engage the ball-type valves and move the ball-type valves to their opened position while still permitting flow between the passages.

14. The valve assembly of claim 10, wherein the means for moving the ball-type valves transversely comprises a member supported for pivotal movement about a rotary axis extending parallel to but offset from the passages.

15. The valve assembly as set forth in claim 12, wherein the housing defines a second passage in opposition to the first passage and valved by a second ball-type valve urged to its closed position by the coil compression spring and the means for moving the ball-type valve moves both of the ball-type valves transversely relative to their respective flow passages.

* * * * *